US009564099B2

(12) United States Patent
Esfahani et al.

(10) Patent No.: US 9,564,099 B2
(45) Date of Patent: Feb. 7, 2017

(54) BISTABLE DISPLAY SYSTEMS AND METHODS

(71) Applicant: Lumotune Inc., Kitchener (CA)

(72) Inventors: Matin Esfahani, Toronto (CA); Hooman Safaee, Mississauga (CA); Mohammad Shafi Ahsan Siddiqi, Milton (CA); Aman Muthreja, Milton (CA)

(73) Assignee: Lumotune Inc., Kitchener, Ontario (CA)

( * ) Notice: Subject to any disclaimer, the term of this patent is extended or adjusted under 35 U.S.C. 154(b) by 91 days.

(21) Appl. No.: 14/643,549

(22) Filed: Mar. 10, 2015

(65) Prior Publication Data

US 2015/0255036 A1 Sep. 10, 2015

Related U.S. Application Data

(60) Provisional application No. 61/950,690, filed on Mar. 10, 2014.

(51) Int. Cl.
*G09G 3/36* (2006.01)

(52) U.S. Cl.
CPC ..... *G09G 3/3696* (2013.01); *G09G 3/3629* (2013.01); *G09G 2330/021* (2013.01)

(58) Field of Classification Search
None
See application file for complete search history.

(56) References Cited

U.S. PATENT DOCUMENTS 5,729,320 A 3/1998 Eidenschink et al.
5,956,113 A 9/1999 Crawford
6,016,133 A 1/2000 Nito et al.
6,329,967 B1 12/2001 Little et al.
6,831,716 B2 12/2004 Dozov et al.
7,561,131 B2 7/2009 Ijzerman et al.
7,800,812 B2 9/2010 Moskowitz
8,098,421 B2 1/2012 Moskowitz
8,107,050 B2 1/2012 Hsieh et al.
8,237,324 B2 8/2012 Pei et al.
2002/0026734 A1 3/2002 Bayrle et al.
2005/0180645 A1* 8/2005 Hasegawa ..... G06K 9/00456 382/239
2008/0246703 A1 10/2008 Smith (Continued)

FOREIGN PATENT DOCUMENTS

CN 100545713 C 9/2009
EP 2312386 A1 4/2011

OTHER PUBLICATIONS

Google Patents English translation of CN 100545713 C, Nov. 13, 2015.

(Continued)

*Primary Examiner* — Larry Sternbane
(74) *Attorney, Agent, or Firm* — Bereskin & Parr LLP

(57) ABSTRACT

A bistable display system includes a plurality of pixels arranged in pixel rows and pixel columns. Each pixel has a bistable material between first and second transparent and conductive substrates. A bistable display method includes driving the plurality of pixels having at least one target pixel and at least one non-target pixel and applying a voltage difference across at least one target column and at least one target row to switch the at least one target pixel between transparent and opaque states.

17 Claims, 19 Drawing Sheets

(56) References Cited

U.S. PATENT DOCUMENTS

| | | | | |
|---|---|---|---|---|
| 2009/0290078 | A1* | 11/2009 | Yang | G02F 1/13718 349/16 |
| 2010/0289790 | A1* | 11/2010 | Cheng | G09G 3/344 345/212 |
| 2011/0187684 | A1* | 8/2011 | Amundson | G09G 5/00 345/204 |
| 2016/0115389 | A1* | 4/2016 | Lim | C09K 19/10 349/16 |

OTHER PUBLICATIONS

Smart Tint Website, http://shop.smarttint.com/Smart-Tint-Buy-It-Now-Order-Page_b_54 html.
SPD Control Systems Corporation Website, http://www.spdcontrolsystems.com/index.htm.
Eclipse Electric Glass Website, http://www.eclipseelectricglass.co.uk/

* cited by examiner

BISTABLE DISPLAY SYSTEMS AND METHODS

RELATED APPLICATIONS

This application claims the benefit of U.S. Provisional Patent Application Ser. No. 61/950,690 filed on Mar. 10, 2014 entitled "Monochromatic Bistable Transparent Reflective Display", the entire contents of which are hereby incorporated by reference herein for all purposes.

FIELD

The present application relates generally to display devices. More particularly, the present application relates to bistable display systems and methods.

BACKGROUND

Bistable display devices may include smart glass. Smart glass generally refers to glass materials that change transparency upon an application of a voltage, heat, or light. Active chromogenic materials are a class of materials that may change light transmission properties when voltage is applied. Active chromogenic materials may be used in products such as smart glass, smart film, smart windows, switchable glass, and intelligent glass devices.

Types of smart glass devices may be differentiated based on fabrication technology; liquid crystals, polymer dispersed liquid crystals, electrochromic, suspended particle devices, reflective hydrides and others, as is known in the art.

Smart glass may be used in a range of industry sectors, including construction, transportation, aerospace, electronics, consumer products, optics, energy and sensors.

Smart glass devices may be powered by an appropriate power source. Power requirements may depend on the type of smart glass device. In some applications a knob or switch is used to regulate the voltage applied to the smart glass device. This gives users the ability to control light transmission properties of the smart glass device through a physical interface located on or near the smart glass device.

Monochrome display devices display images, text, and/or patterns in one colour or in shades of one colour. Images using only shades of grey (with or without black and/or white) are grayscale or black-and-white images. A monochromatic image may be black and white, grayscale, or other combinations containing only tones of a single colour.

Monochrome display devices may include bistable displays such as electronic paper or e-paper. Electronic paper can switch between black and white states in order to display the monochromatic image. As bistable displays can maintain the display state without requiring a continuous electrical field, costs of operating such display devices may be reduced. Due to the properties of electronic paper, electronic paper lacks the ability to become transparent.

Conventional display devices such as polymer dispersed liquid crystals (PDLC) may not be bistable. Instead, the liquid crystals are by default in an opaque state. The liquid crystals align in parallel to achieve a transparent state when an electrical field applied to them. In these devices, the transparent state remains only as long as electrical current is being applied. Once the electrical field is turned off, the liquid crystals resort back to a random arrangement resulting in scattering of light and an opaque, "milky white" appearance occurs.

SUMMARY

According to some embodiments, there is a bistable display system including a plurality of pixels, arranged in pixel rows and pixel columns. Each pixel includes a first transparent and conductive substrate, a second transparent and conductive substrate, and a bistable material between the first and second substrates having a first state and a second state.

In an embodiment, the first state is a transparent state such that the pixel is transparent and the second state is an opaque state such that the pixel is opaque.

In an embodiment, the bistable material is a liquid crystal material that changes between the first and second states based on a drive voltage applied across the first and second substrates.

In an embodiment, the bistable display system further includes a power source for providing the drive voltage to the plurality of pixels. When the power source is disconnected from the plurality of pixels the state of the bistable material does not change.

In an embodiment, the bistable material is a smectic A liquid crystal.

In an embodiment, the bistable display system further includes a driver for driving the pixel rows and pixel columns to change the state of at least one targeted pixel.

In an embodiment, the driver is a cascadable driver interface.

In an embodiment, the driver includes a column driver having a plurality of single pole double throw switches to simultaneously drive the pixel columns by a column voltage and a ground. The driver includes a row driver having a single pole single throw switch to alternatively drive the pixel rows by a row voltage or disconnect the pixel row. The difference between the row voltage and column voltage is the drive voltage.

In an embodiment, the bistable material has a change threshold voltage that initiates the change between the first and second states. The column voltage is less than the change threshold voltage. The row voltage is less than the change threshold voltage. The drive voltage is greater than the change threshold voltage.

In an embodiment, the bistable display system further includes a controller for creating the row voltage and the column voltage to send to the row and column drivers.

In an embodiment, the controller has a first operational amplifier for amplifying a low voltage input signal to provide the column voltage, an inverter for inverting the low voltage input signal to provide an inverted low voltage signal, and a second operational amplifier for amplifying the inverted low voltage signal to provide the row voltage, such that the row voltage is inverse to the column voltage.

In an embodiment, the column voltage and the row voltage are high voltage square waves.

In an embodiment, the bistable display system further includes a processing module for processing image display data into the low voltage input signal for use by the controller.

In an embodiment, the processing module includes a monochromatic module for converting the image display data into monochrome image data. In an embodiment, the processing module includes a non-linear display driving module for converting the monochrome image data into row and column data. In an embodiment, the processing module includes a data compression module for compressing the row and column data into compressed row/column data.

According to some embodiments, there is a method for controlling a bistable display. The method includes driving a plurality of pixels including at least one target pixel and at least one non-target pixel, arranged in pixel rows and pixel columns and applying a voltage difference across at least one target column and at least one target row to switch the at least one target pixel between a transparent state and an opaque state.

In an embodiment, the method further includes driving the at least one target column to a column voltage, grounding non-targeted columns, driving the at least one target row to a row voltage, wherein the column and row voltages are 180 degrees out of phase and equal in magnitude, such that the voltage difference is equal to twice the column voltage, and disconnecting non-targeted rows such that non-targeted pixels will be driven to a float voltage, wherein the float voltage is equal to the mean of the column voltages.

In an embodiment, the method further includes creating and amplifying a first signal at a transparent or opaque frequency for the target column, creating, inverting, and amplifying a second signal at the transparent or opaque frequency for the target row, and waiting a fixed period of time for the bistable display to respond to the signals before turning off the first and second signals.

In an embodiment, the method further includes comparing a first image that is currently being displayed by the bistable display to a second image that is requested to be displayed on the bistable display, and identifying the target pixels to be switched.

In an embodiment, the method further includes producing a first matrix which describes the target pixels for switching from opaque to transparent, producing a second matrix which describes the target pixels for switching from transparent to opaque, wherein the first and second matrices include rows and columns of pixel data, ordering the rows of the first and second matrices by the number of switches each row performs, starting with the row with the fewest switches, determining the number of other rows that the row is a subset of, switching the current row and the identical subset in the other rows, and once the current row and other rows that contain the same number of switches have been driven, removing the corresponding switches from the rows that have been driven.

In an embodiment, the method further includes receiving monochrome image data including black and white pixel data, converting the black and white pixel data into binary data, encoding the binary data into characters, and sending the characters to the bistable display.

Other aspects and features will become apparent, to those ordinarily skilled in the art, upon review of the following description of some exemplary embodiments.

BRIEF DESCRIPTION OF THE DRAWINGS

The drawings included herewith are for illustrating various examples of articles, methods, and apparatuses of the present specification. In the drawings.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed below that is not claimed in this document may be the subject matter of another protective instrument, for example, a continuing patent application, and the applicants, inventors or owners do not intend to abandon, disclaim or dedicate to the public any such invention by its disclosure in this document.

Figure 1:
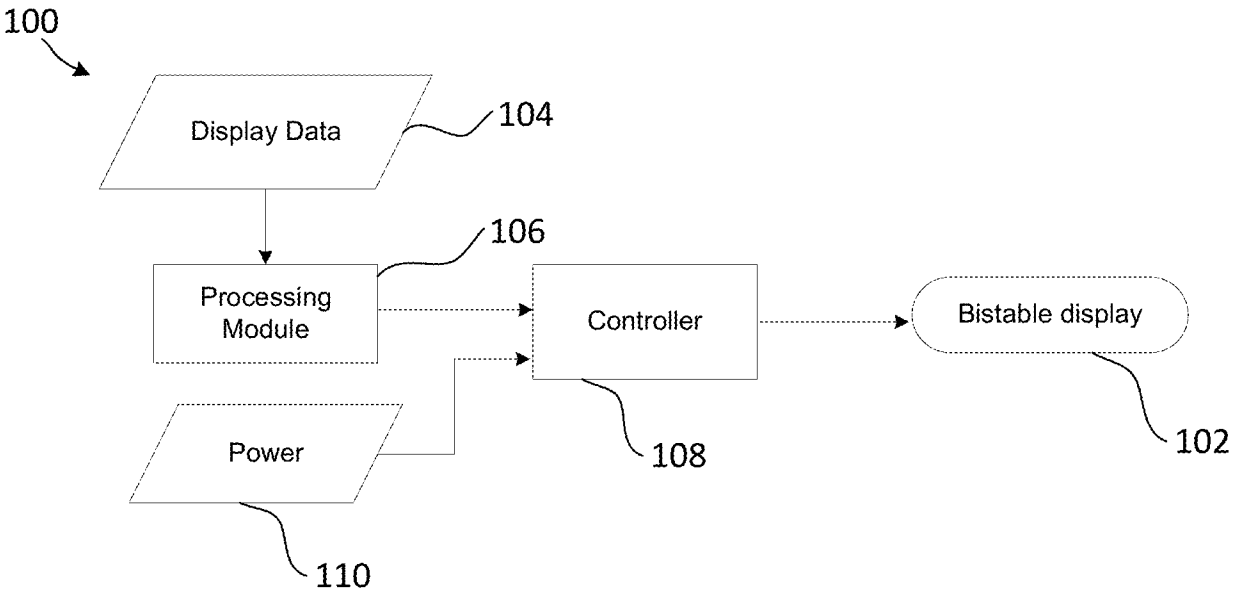
FIG. 1 is a block diagram of a system for controlling a bistable display, in accordance with an embodiment.

FIG. 1 illustrates a system 100 for controlling a bistable display 102, in accordance with an embodiment. A user device (not shown), such as a mobile phone, tablet, a personal computer or others, allows a user to control the bistable display 102. The user inputs display data 104 into the user device. Display data 104 may include user instructions such as an image to display or text to display. The display data 104 is transmitted to a processing module 106.

The display data 104 may be transmitted over a network, such as an IEEE 802 network. Using an IEEE 802 network such as Wi-Fi may offer the advantage of compatibility because many locations already use Wi-Fi to connect to user devices.

The processing module 106 converts the display data 104 to be input into a controller 108. The controller 108 may include, for example, a cascadable driver interface for controlling the bistable display 102.

The system 100 includes a power source 110 that provides electrical power to the controller 108. The bistable display 102 may be one large display, or may include an array of pixels that may be individually controlled.

Figure 2:
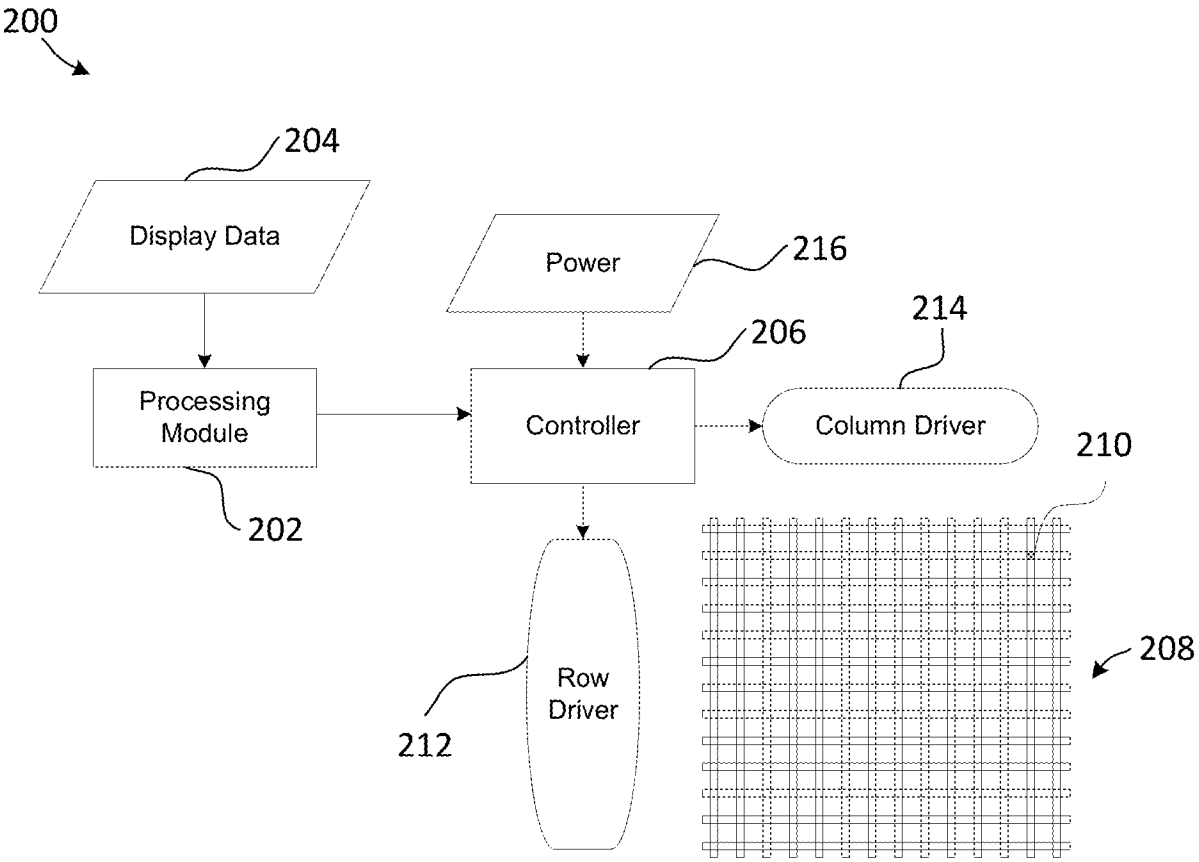
FIG. 2 is a block diagram of a system for controlling a bistable display having a plurality of pixels, in accordance with an embodiment.

FIG. 2 illustrates a bistable display system 200, in accordance with an embodiment. The bistable display system 200 includes a processing module 202 for image processing and which converts display data 204 for use by a controller 206. The display data 204 includes an indication from a user to change the display properties of a bistable display 208.

The controller 206 uses a row-column method such as passive matrix addressing to translate the display data 204 into electrical signals. The controller 206 sends the electrical signals to at least one pixel 210 on the bistable display 208. The bistable display system 200 includes a row driver 212 and a column driver 214 to drive rows and columns of pixels 210. The pixels 210 include a bistable material (not shown). The bistable display includes an optoelectronic material that can switch between transparent and opaque and is bistable. For example the optoelectronic material may be smectic A Liquid Crystals (SmA LC) or the like.

The controller 208 applies an electrical field across the identified pixel(s) 210 to display images, text, and/or patterns. The bistable material reorients depending on the magnitude and frequency of the voltage being applied across the pixel 210 to become transparent or opaque.

The bistable display system 200 includes an external power source 216 that connects to the controller 206. In some embodiments, the power source 216 may be removed or disconnected from the bistable display 208 without affecting the state of the bistable liquid crystal material (not shown) in the pixels 210, and the image displayed on the bistable display 208 remains. In an embodiment, the bistable display has low power use as the state of an image is maintained without consuming extra power (i.e. bistable).

Voltage ranges for the bistable display system 200 may include approximately 90-120V for inducing both the transparent state and the opaque state of pixels 210 of the bistable display 208.

Figure 3A:
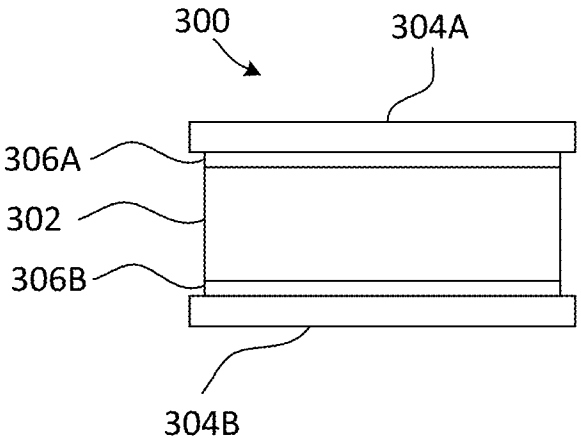
FIG. 3A is a block diagram of a pixel for a bistable display, in accordance with an embodiment.

FIG. 3A illustrates a pixel 300, in accordance with an embodiment. The pixel 300 includes a bistable material 302 between a first substrate 304A and a second substrate 3048. The bistable material 302 may be an optoelectronic material such as a bistable liquid crystal that can switch between a transparent state and opaque state. The bistable material 302 may have a desired birefringence such that when the bistable material 302 is aligned with the refractive indices oriented in the same direction, light can pass through the film uninterrupted. When the refractive indices are not aligned and are randomly oriented the light encounters changes in the refractive index and scatters causing the material to appear opaque. The bistable material 302 may be a smectic A liquid crystal (SmA LC). The bistable liquid crystal material 302 may also be chosen from a smectic B liquid crystal (SmB LC), a smectic C liquid crystal (SmC LC), a smectic C* liquid crystal (SmC* LC), or a smectic D liquid crystal (SmD LC).

The first and second substrates 304A, 304B are transparent and are, for example, made of a glass or a plastic material. Each substrate 304A, 304B is attached to a transparent electrode 306A. 306B such as a transparent conductive oxide (TCO). TCOs may include Indium Tin Oxide, silver nano wires, carbon nano tubes, or the like. In an embodiment, the bistable display has transparent substrates 304A, 304B such as glass and plastic and has electrically conductive coatings 306A. 306B, such as transparent conductive oxides that have high transparencies and low sheet resistances.

When a voltage is applied to the transparent electrodes 306A, 306B, an electric field is formed between the two substrates 304A, 304B. When the electrical field is applied across the two transparent, conductive substrates 304A, 304B of the pixel 300, the bistable material 302 undergoes a phase change whereby the bistable material 302 reorients itself. The bistable material 302 may include a plurality of charge carriers (not shown).

Depending on the magnitude and frequency of the voltage being applied to the pixel 300, the bistable material 302 reorients a certain degree that can result in transparency, opaqueness, or varying degrees in between.

Depending on the frequency of the electrical field, such as an alternating current (AC) field, the pixel 300 can be switched between a transparent state and an opaque state. Where the electrical field is at a low frequency, the charge carriers disrupt the orientation of the bistable material 302 to cause a change in the display properties to the opaque state. Low frequencies may be in the range of 1 to 100 Hz.

Where the electrical field is high, the charge carriers do not have time to respond to the electric field and restoring force from dielectric anisotropy dominates in the bistable material 302 to cause a change in the display properties to the transparent state. High frequencies may be in the range of 250 to 2000 Hz. The bistable material 302 changes orientation, and hence the state of the pixel 300, depending on the voltage and frequency applied between the two conductive substrates 304A. 304B.

Figure 3B:
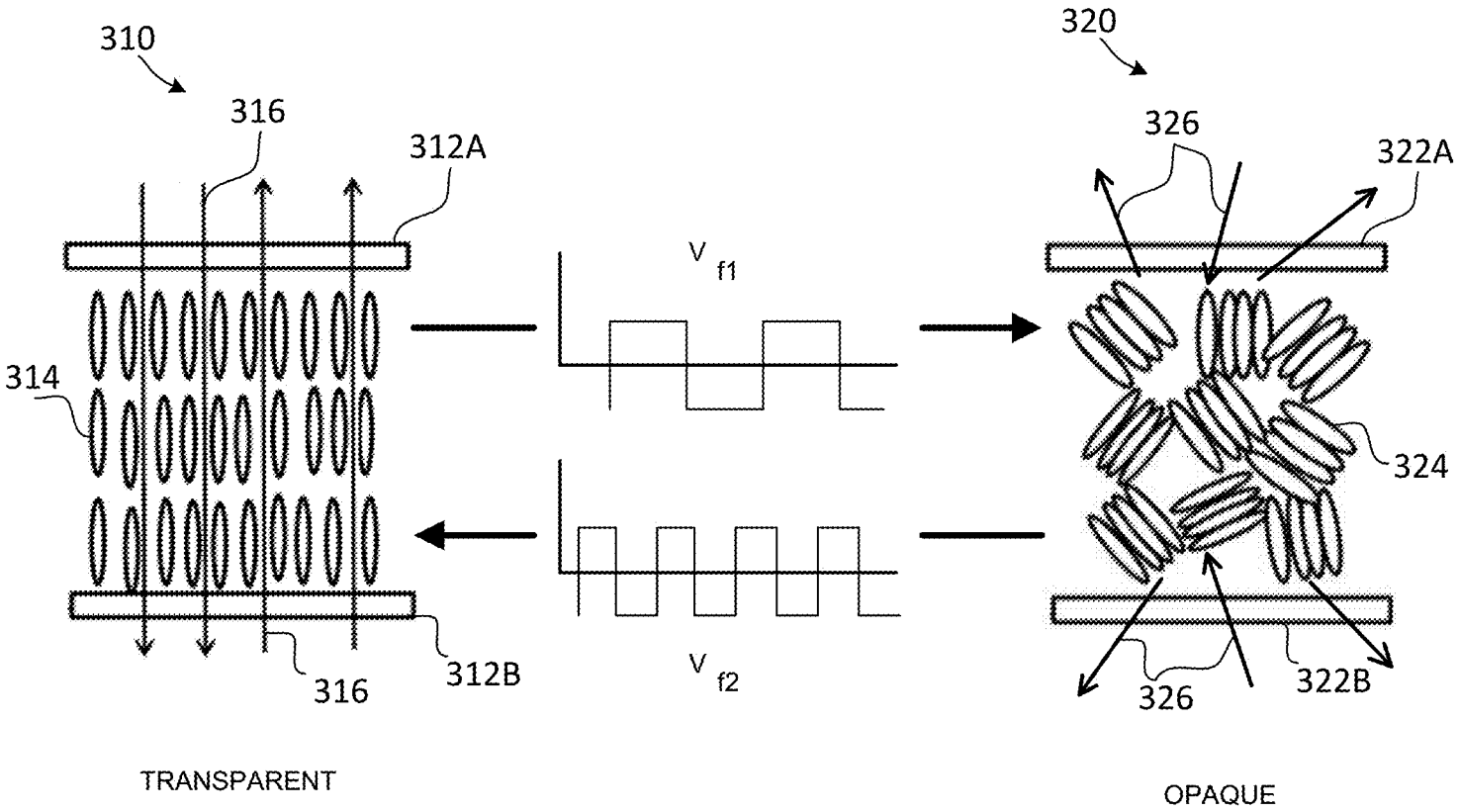
FIG. 3B is a block diagram of a pixel switching between a transparent state and an opaque state, in accordance with an embodiment.

FIG. 3B illustrates a pixel in a transparent state 310 and a pixel in an opaque state 320, in accordance with an embodiment. The transparent pixel 310 includes two conductive substrates 312A, 312B that are naturally transparent. The two transparent conductive substrates 312A, 312B are on opposite sides of a bistable liquid crystal material 314. When the bistable liquid crystal material 314 is arranged in parallel, rays of light 316 pass through and a transparent state is observed.

The opaque pixel 320 includes two transparent conductive substrates 632A, 322B on opposite sides of a bistable liquid crystal material 324. The two conductive substrates 322A, 322B are naturally transparent. When the bistable liquid crystal material 324 is aligned randomly and the average alignment is not parallel, incoming rays of light 326 are scattered and do not pass through and an opaque state is observed.

The bistable material 314, 324 has a change threshold voltage Vt that initiates a change in state, for example from transparent to opaque or from opaque to transparent. In certain cases, the change threshold voltage Vt may be different when changing from transparent to opaque and from opaque to transparent.

Bistability of the transparent and opaque pixels 310, 320 allows the bistable liquid crystal material to exist in two stable energy states. Each energy state corresponds to an average alignment of the liquid crystal molecules which in turn, corresponds to a quantized degree of transparency. When molecules of the bistable liquid crystal material 314, 324 are arranged in one of the stable states, a power source can be disconnected from the transparent and opaque pixels 310, 320 and the stable state at the time of disconnection will remain indefinitely.

The bistable liquid crystal material 314, 324 may have a variety of components that contribute to the functionality of the system. A component may be an optical material having tunable light scattering properties. A component may be a pre-polymer solution that is cured after sandwiching (between 312A and 3128, or 322A and 322B) and may provide mechanical strength. A component may be a dopant that is a charge carrier to induce the change in optical state. A component may be a set of uniformly shaped transparent beads that are distributed throughout the bistable liquid crystal material 314, 324 to control display device thickness and add mechanical stability.

When a voltage (Vf1) at a low frequency (for example 10 Hz to 100 Hz) is applied across the substrates 312A and 312B of the transparent pixel 310, the pixel becomes opaque 320. When a voltage (Vf2) at a high frequency (for example 250 Hz to 2000 Hz) is applied across the substrates 322A and 322B of the opaque pixel 320, the pixel becomes transparent 310. Both the voltages Vf1 and Vf2 are higher than the change threshold voltage Vt of the bistable material such that the state of the pixel 310, 320 will change.

Figure 4:
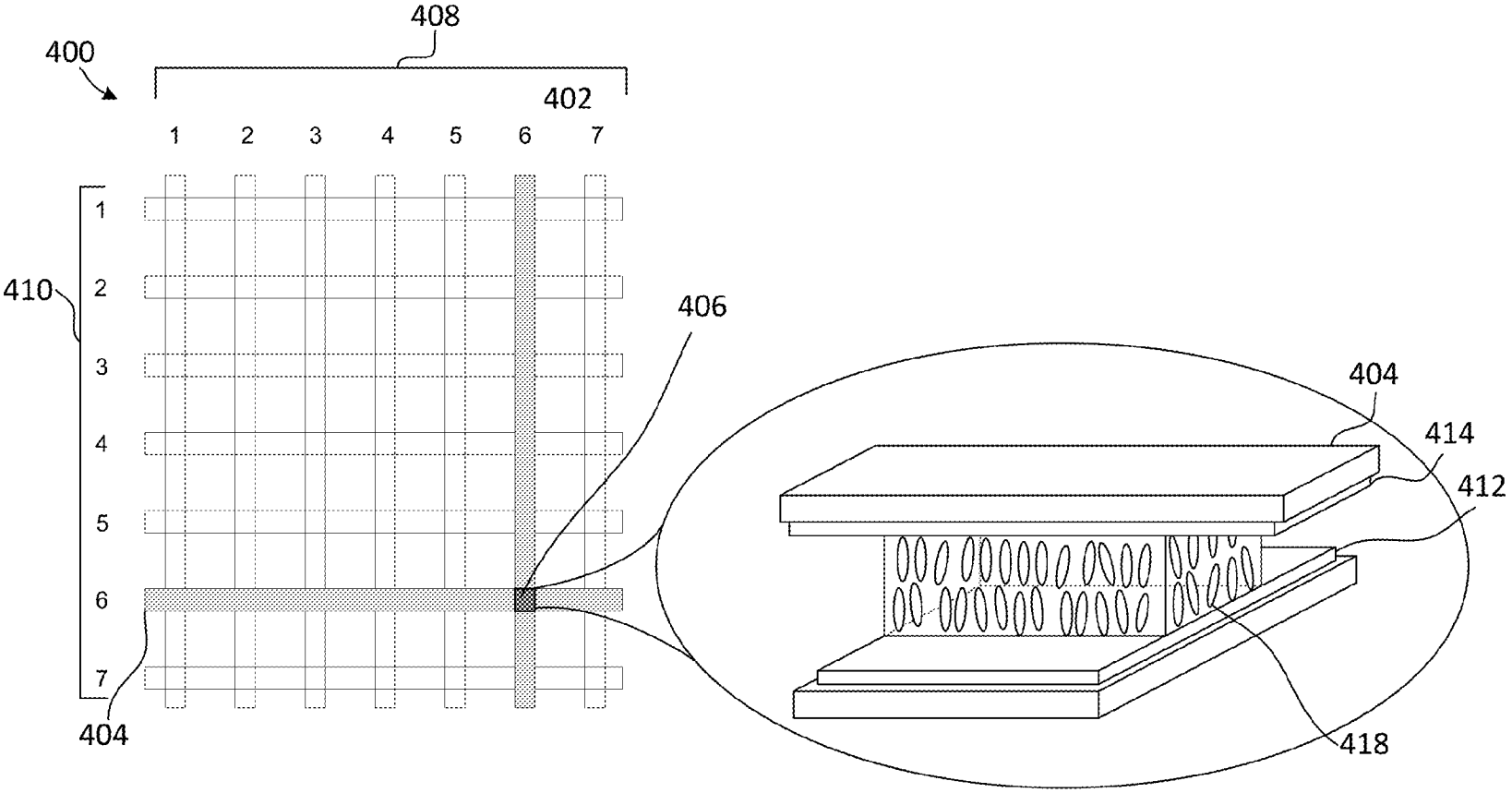
FIG. 4 is a block diagram of a bistable display having a plurality of pixels, in accordance with an embodiment.

FIG. 4 illustrates a bistable display 400, in accordance with an embodiment. The bistable display 400 includes a plurality of pixels 406, for example the pixels 300, 310, 320 described with reference to FIGS. 3A and 3B. The bistable display 400 is made up of columns 408 and rows 410 of pixels 406 to form an array of individual independently controlled pixels. The pixels 406 include a first substrate 402 (e.g. first plate) layered with a second substrate 404 (e.g. second plate). Each pixel 406 may include first and second layers of transparent conductive substrates 412, 414 (for example, Indium-Tin-Oxide). A bistable liquid crystal material 418 is between the first and second conductive substrates 412, 414.

The pixel 406 functions similarly to a capacitor. When a current is applied to the to the first and second conductive substrates 412, 414, an electrical potential difference is created and the electrical properties of the bistable liquid crystal material 418 may be influenced to change the optical properties (for example, transparency) of the pixel 406.

In an embodiment, the bistable display shows white text and/or images on a transparent screen with a desired resolution while using reduced electronic board space. The reduced electronic board space maximizes the number of pixels while minimizing the size of the printed circuit boards. Electronics for SmA LCs have certain electrical properties using (1) high voltage (for example, 60V-200V), (2) signals with variable frequencies, and (3) alternating current. In some cases, electrical components in the industry may not be designed to allow for these types kind of signals be sent. The bistable display of the present disclosure may include high voltage analog switches to allow for the high voltage, variable frequency and alternating current signals used to control bistable transparent materials such as SmA LCs.

Figure 5:
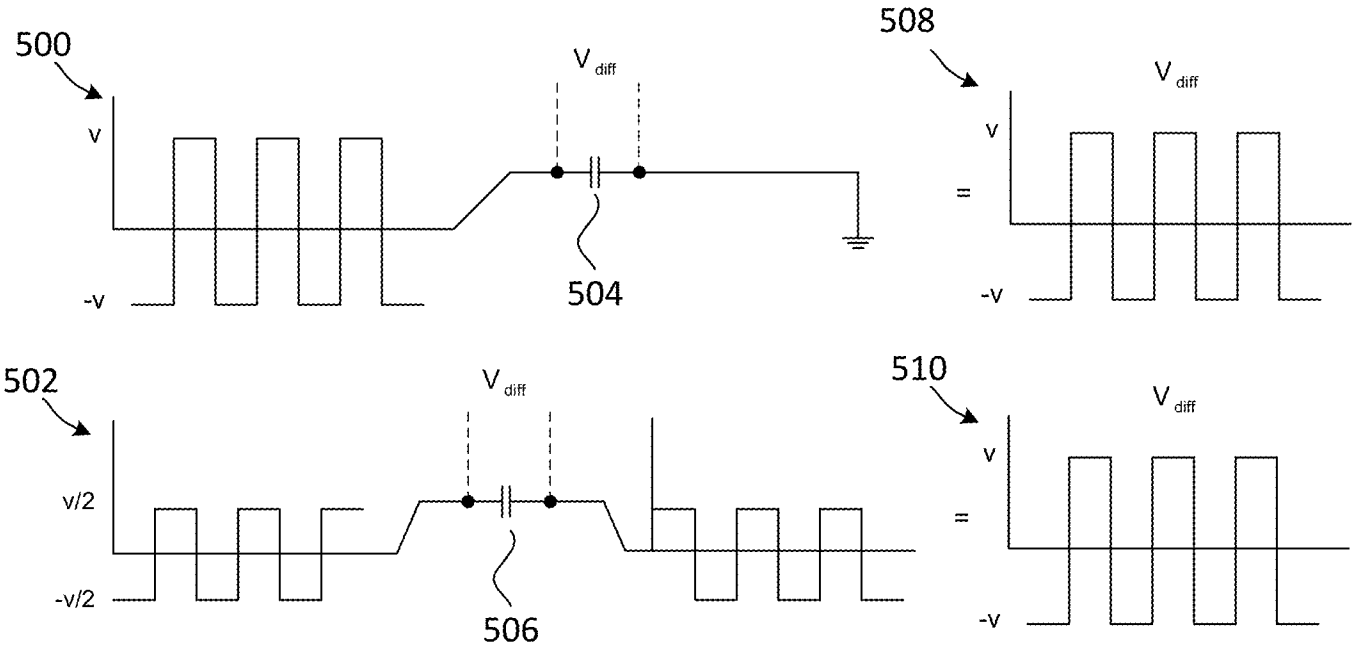
FIG. 5 is a graph of square waves for driving a bistable display, in accordance with an embodiment.

FIG. 5 illustrates square waves 500, 502 for driving a bistable display, in accordance with an embodiment. The square wave 500 drives a pixel 504 from one side (e.g. 304A of FIG. 3A) of the pixel 504 at voltages (+V and −V) while grounding the other side.

The square wave 502 drives a pixel 506 from both sides (e.g. 304A and 304B of FIG. 3A) such that the square wave 502 differentially drives the pixels. The pixels are driven by two high voltage signals (+v/2 and −v/2) that are 180 degrees out of phase and that are half the voltage V of square wave 500, which may reduce the amount of generated voltage for driving the pixels. In both the square waves 500, 502, the electrical field and the voltage (Vdiff) seen across the pixel 508, 510 are the same.

Driving at half of the voltage V may make the electronics smaller and may reduce crosstalk (e.g. as described with respect to FIGS. 6A to 6F), as half of the voltage V is less than a change threshold voltage Vt of the pixel's bistable material. In contrast, the voltage V may be greater than the change threshold voltage Vt that may induce crosstalk.

FIGS. 6A to 6F illustrate a bistable display 600 that has target pixel(s) 602 to have its optical properties be changed, in accordance with an embodiment. The bistable display 600 includes rows 604 and columns 606 of the pixels 602. Where it is desirable to change the display properties of the target pixel(s) 602, a voltage difference is applied across target column(s) 608 and target row(s) 610. The target column(s) 608 are driven to a column voltage V1 and the target row(s) 610 are driven to a row voltage V2. In an embodiment, the column and row voltages V1, V2 are 180 degrees out of phase and equal in magnitude, such that the voltage difference V3 which appears across the pixel 602 is equal to 2*V1=2*V2, for example, V1, V2, V3, and as described with reference to FIG. 5.

Non-targeted columns 612 are grounded. Non-targeted rows 614 are disconnected or will "float". As the non-targeted rows 614 are disconnected, a float voltage Vf at those nodes will fluctuate depending on what column 608 is being driven. Specifically, the pixels of the non-targeted rows and columns 614, 612 will float to the average value across the columns, the float voltage Vf. Accordingly, the float voltage Vf is equal to the mean of the column voltages (e.g. V1/n, where n is the number of columns). The non-targeted rows 614 are driven to the float voltage Vf because the column voltage V1 driven on the targeted columns 608 are capacitively coupled through the plurality of pixels to the non-targeted rows 614 as the voltage is going through these pixels. However, since the non-targeted columns 612 are at different voltages going "through" the pixel into the row, the non-targeted rows 614 will "float" to the average of the columns. The pixels of the targeted columns 608 and non-targeted rows 614 will be driven to a voltage Vd which is equal to column voltage V1 reduced by the float voltage Vf.

The bistable material has at least one change threshold voltage Vt that initiates a change in state, for example from transparent to opaque or from opaque to transparent. The column voltage V1 and the row voltage V2 are less than the bistable material's change threshold voltage Vt, while the voltage difference V3 is greater than the change threshold voltage Vt. As such, the drive voltage V3 will switch only the target pixel 602. Other pixels that see less than the drive voltage V3 will not switch. As the bistable display 600 is monochromatic and binary, the greyscale of the non-targeted pixels will not switch. This is in contrast to conventional displays, where grayscale may change in non-targeted pixels.

Figure 6A:
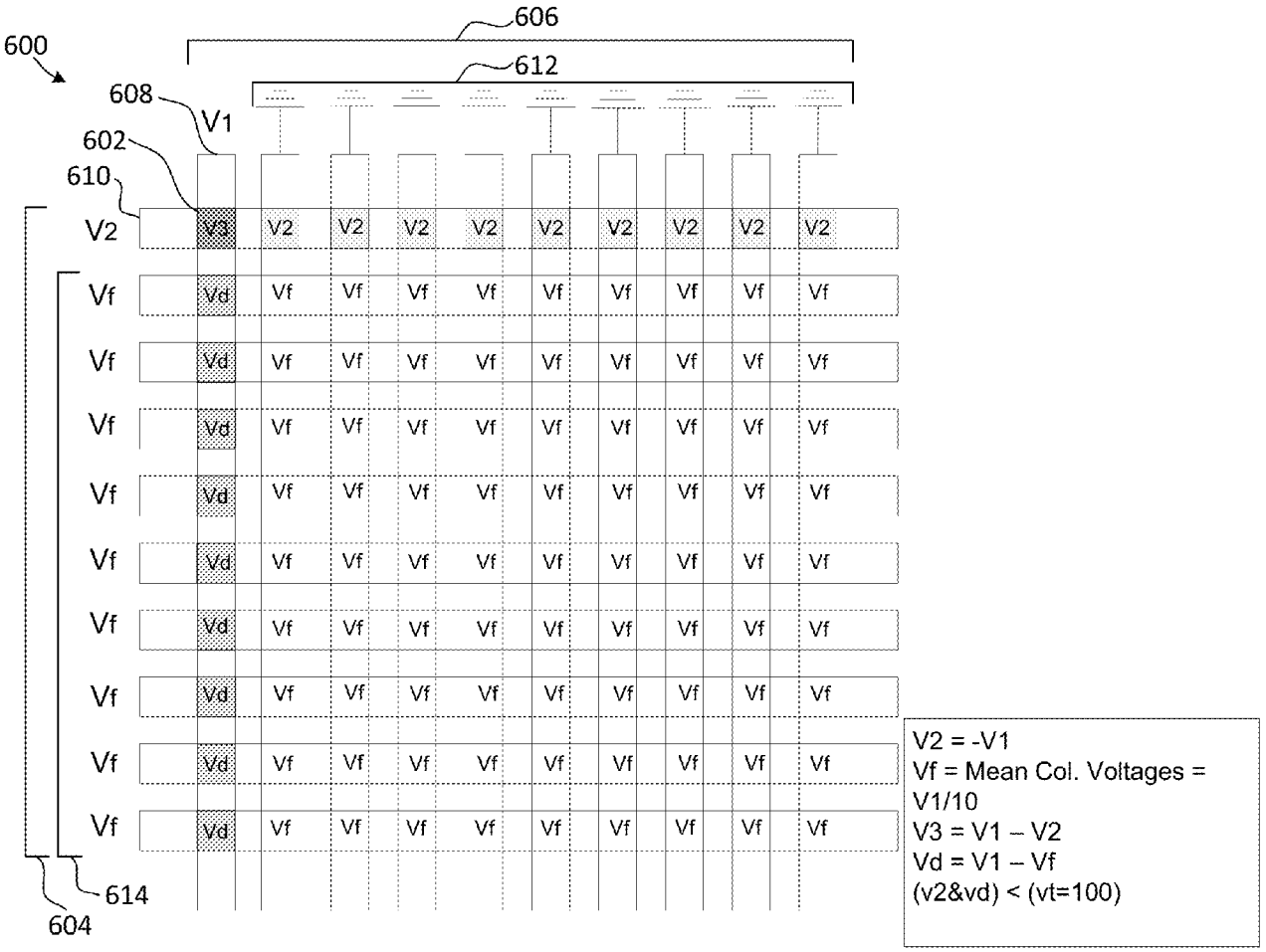
FIGS. 6A to 6F are block diagrams of a bistable display displaying different target pixels, in accordance with an embodiment.
Figure 6B:
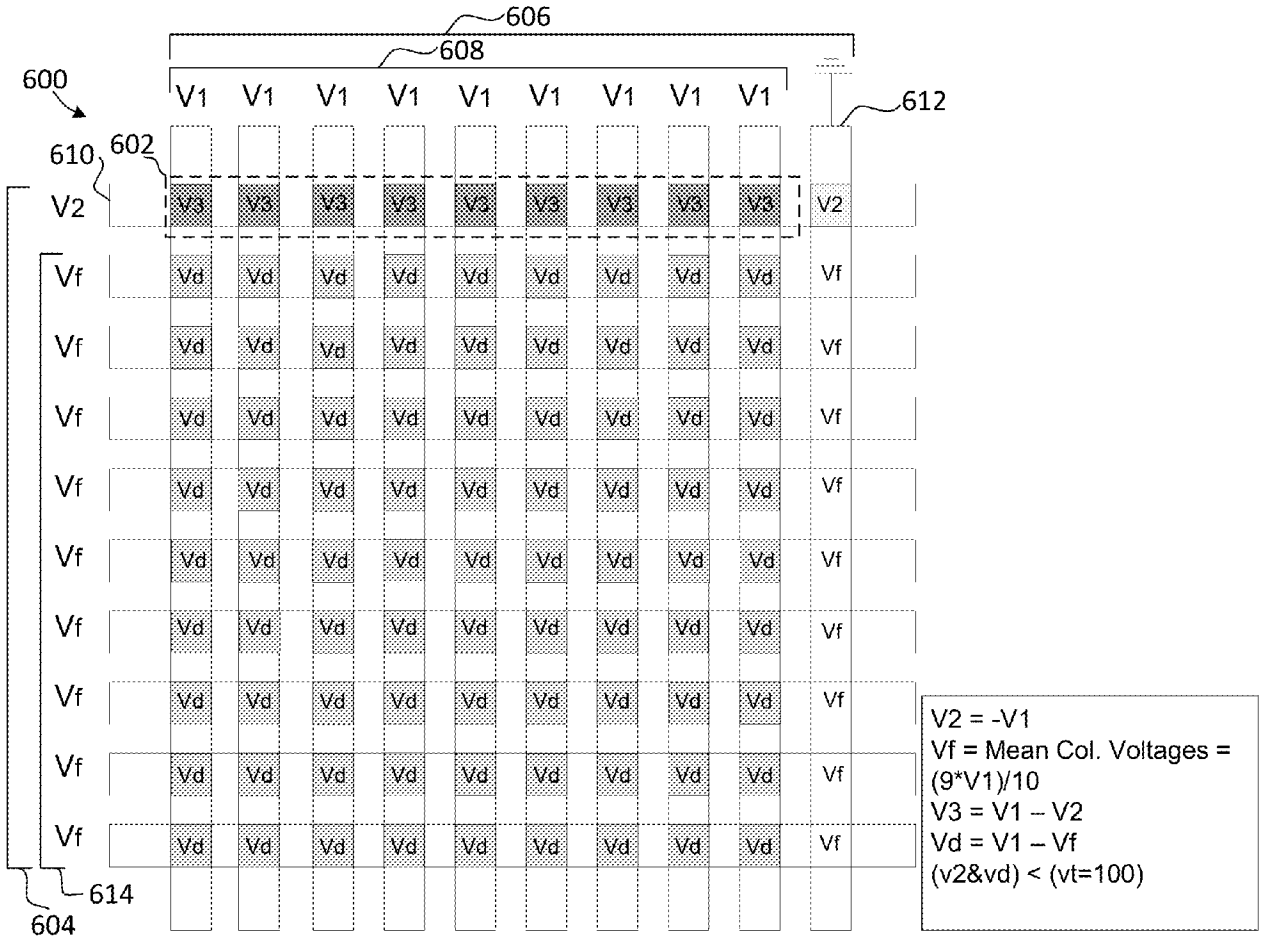
Figure 6C:
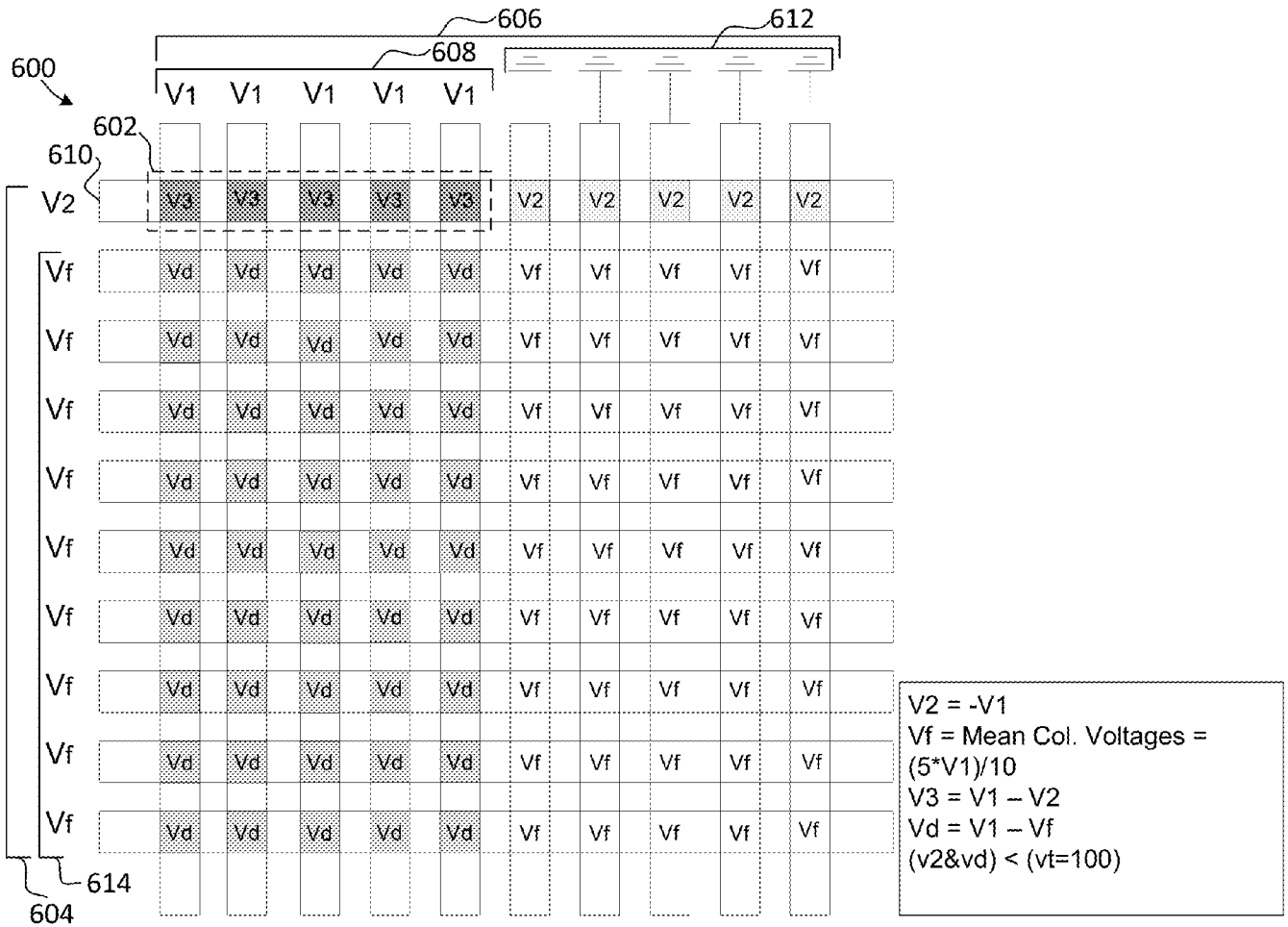
Figure 6D:
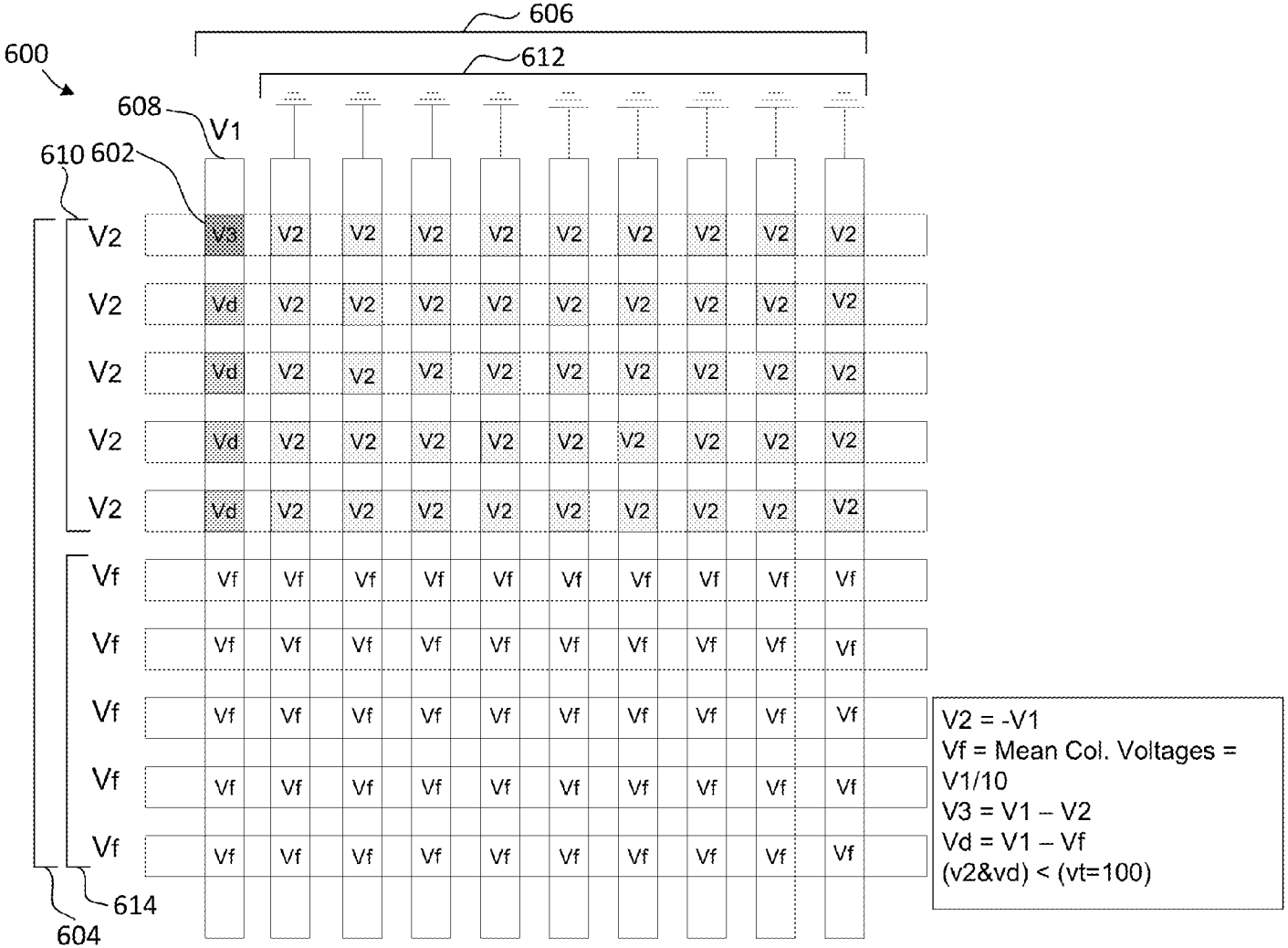
Figure 6E:
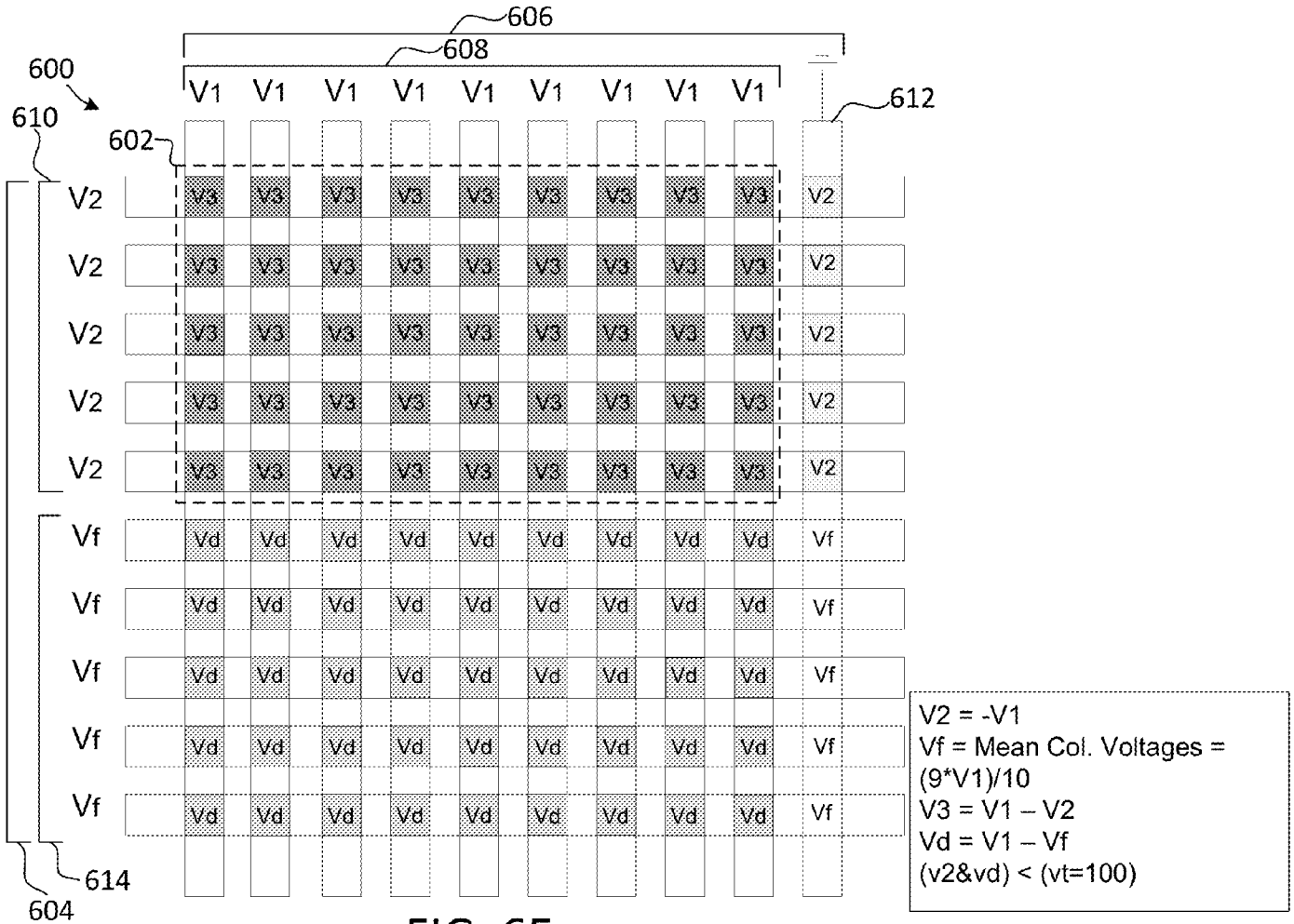
Figure 6F:
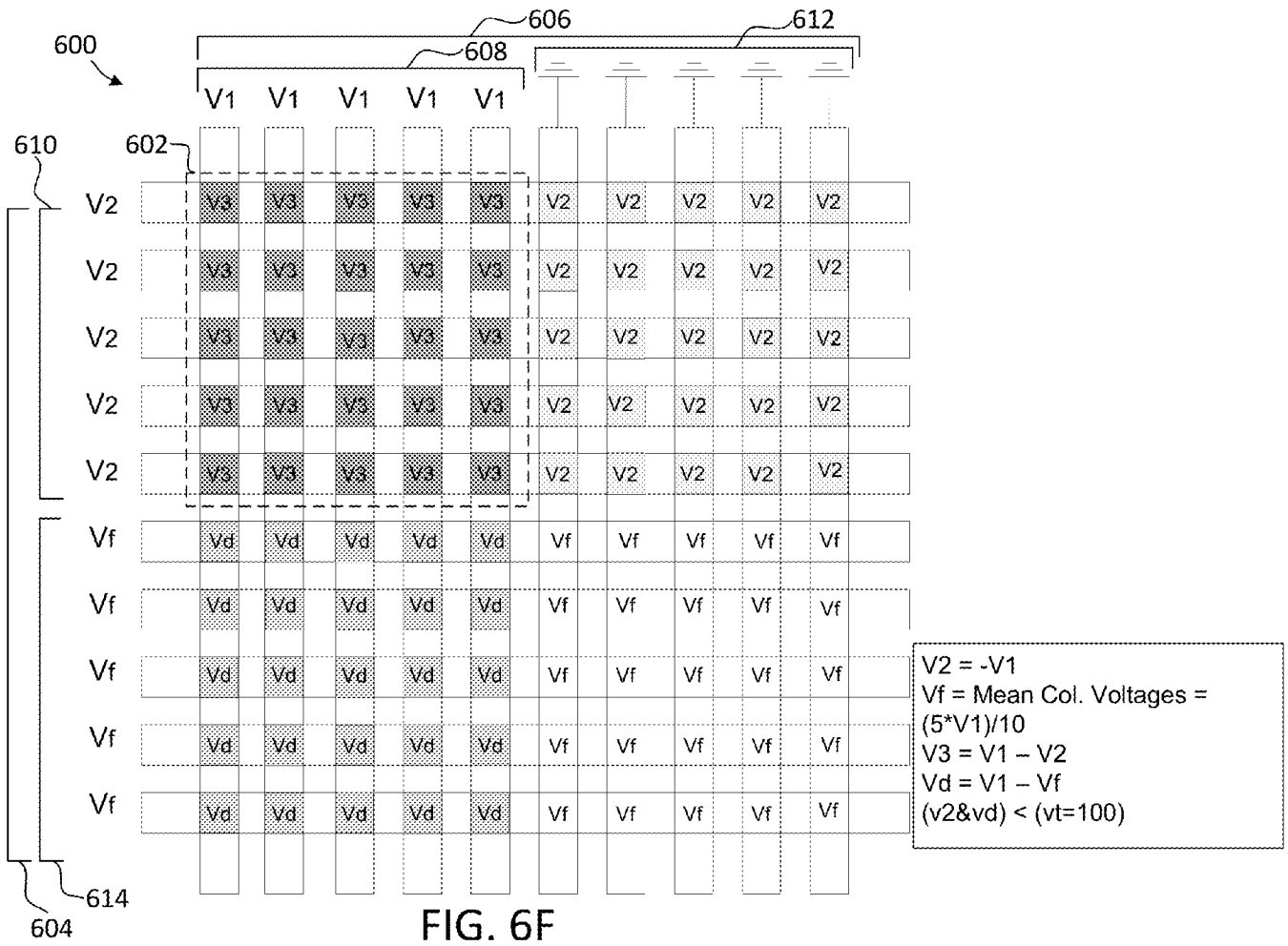

FIG. 6A illustrates targeting the pixel 602 in the first row 610 and the first column 608. The non-targeted columns 612 are grounded and the non-targeted rows 614 float to the average of the columns, which in this example is (V1+9*0)/10=V1/10. Across the targeted pixel 602, the voltage is the drive voltage V3=V1−V2>Vt, thus the pixel 602 switches. The rest of the first row ($P_{x1}$), the pixels are at row voltage V2, where V2<Vt, and do not switch On the first column ($P_{1X}$), the pixels see V1−Vf=9/10* V1 and as V1<Vt, 9/10*V1<Vt, and do not switch. Finally, the rest of the pixels are at the float voltage Vf=1/10*V1<Vt, and not switch.

FIGS. 6A-6F are variations of targeted pixels 602 to illustrate that crosstalk (i.e. having unwanted pixels change) may not occur in edge cases.

Figure 7:
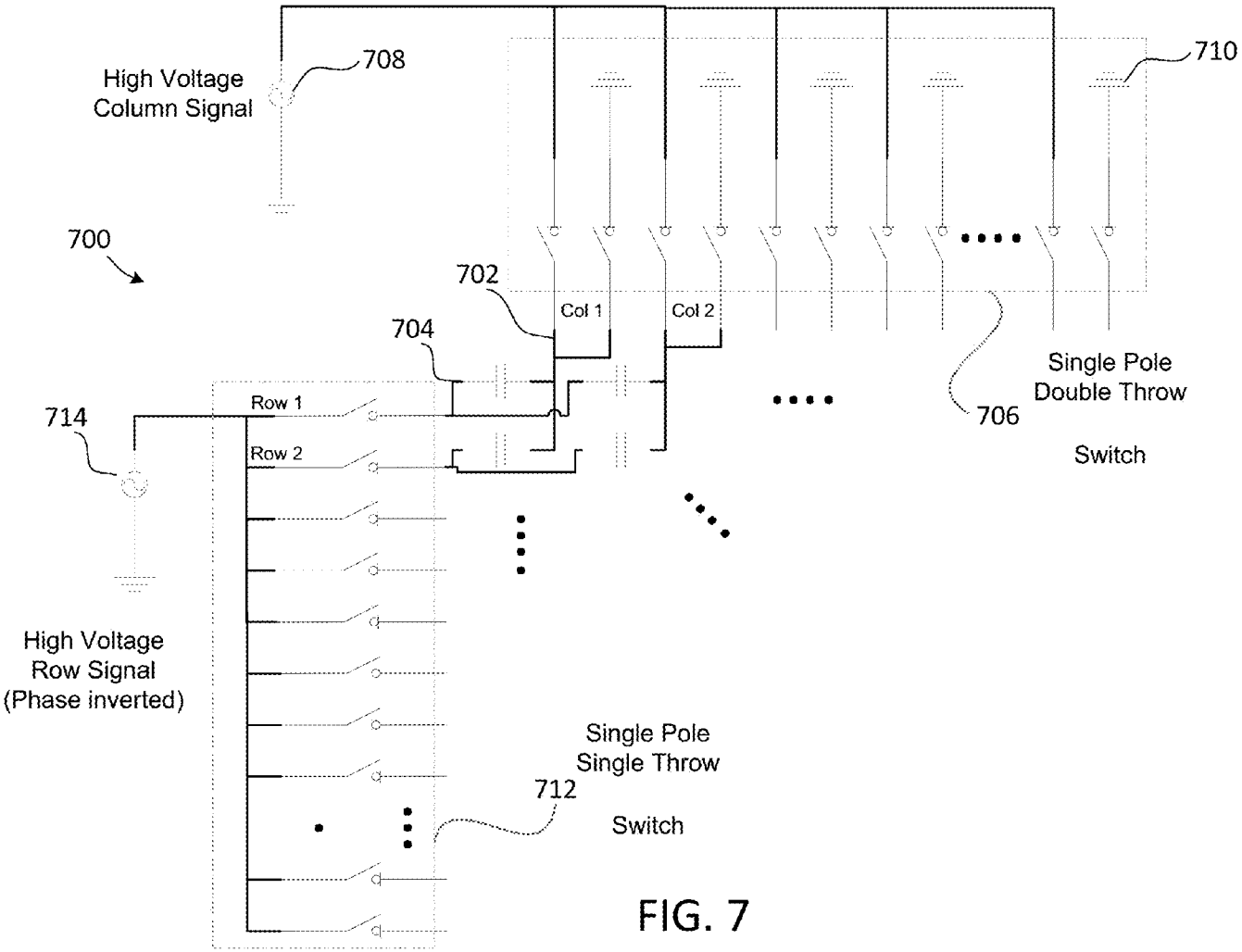
FIG. 7 is a block diagram of a driver for driving a bistable display, in accordance with an embodiment.

FIG. 7 illustrates a driver 700 for driving a bistable display, in accordance with an embodiment. The driver 700 may be, for example, a cascadable driver interface and/or the controllers 108, 206 of FIGS. 1 and 2. The driver 700 connects to columns 702 and rows 704 of pixels on a bistable display (not shown) to drive a targeted pixel(s) by a determined voltage.

The driver 700 includes a plurality of single pole double throw (SPDT) switches 706 to simultaneously drive the columns 702 by a determined high voltage column signal 708 and a ground 710. The driver 700 includes a single pole single throw (SPST) switch 712 to alliteratively drive the rows by a determined high voltage row signal 714 (e.g. the inverse of the determined high voltage column signal 708), or disconnected. The driver 700 may drive the targeted pixels to be switched as described with reference to FIGS. 6A-6F.

In an embodiment, the switches 706, 712 may be expanded in a modular way allowing cascading and a customizable size of the bistable display for a given application.

In an embodiment, the bistable display is size-customizable and modular, such that the bistable display can be fabricated in varying sizes and cut down to exact sizes depending on the desired use size. The bistable display may use passive matrix architecture and the bistable display can be customized in size. The bistable display may be fabricated without thin-film-transistors (TFTs) which may not be modular. In some cases, the bistable display may be attached in series to multiple bistable displays to provide an unlimited number of outputs. The bistable display includes high voltage analog switches that can be chained together to provide outputs for the bistable displays.

In certain conventional displays there may be problems which may be attributed to the passive matrix design, for example, associated with cross-talk among pixels. Conventional displays may use liquid crystal displays (LCDs) that use active matrix architectures, however LCDs are light emitting, use continuous power, and are not transparent. In an embodiment of the present disclosure, the bistable display uses passive matrix architecture which may reduce cross-talk among pixels. Where the bistable display includes materials such as SmA LCs the pixels may be addressed using a bistable display method including differential driving of pixels.

Figure 8:
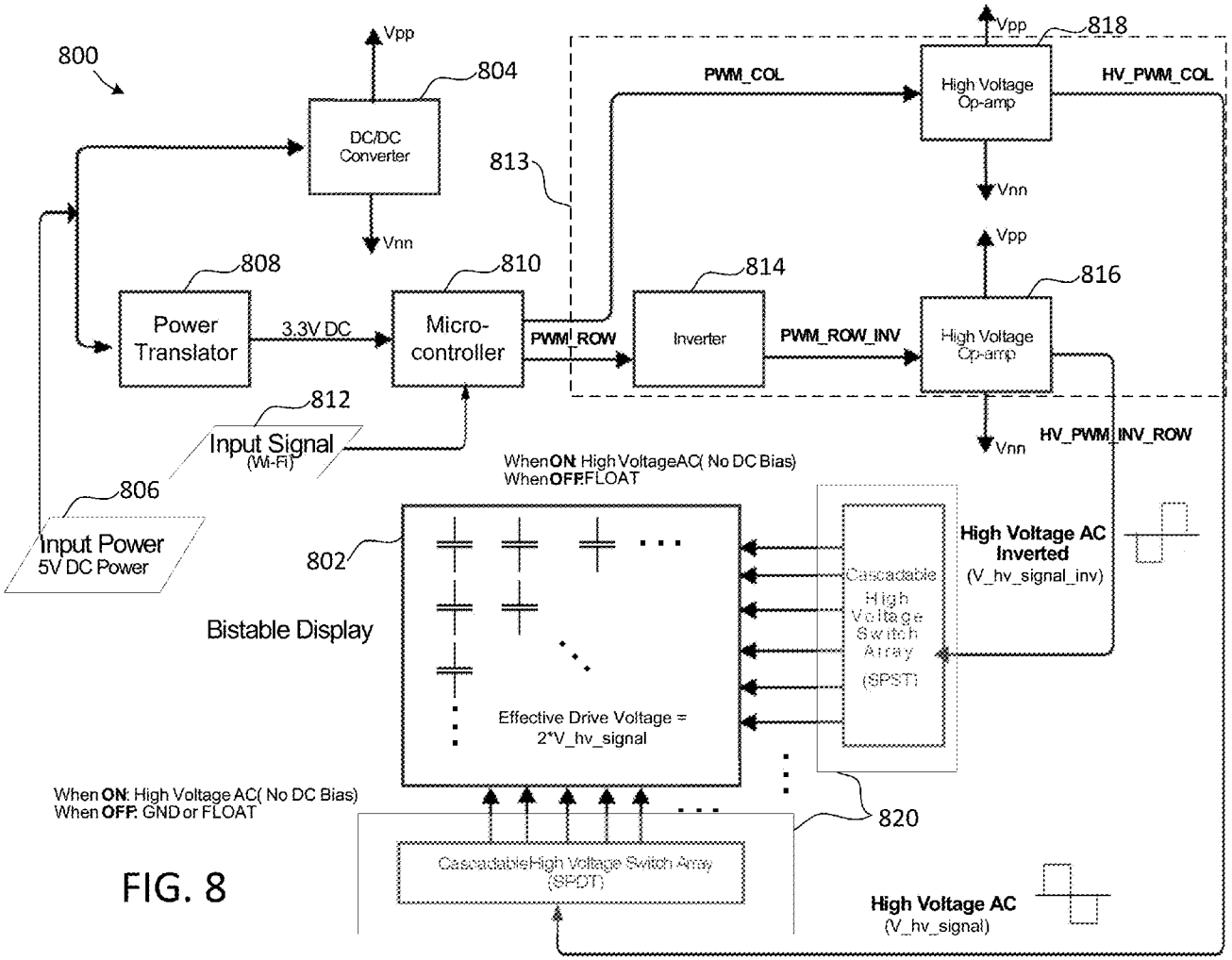
FIG. 8 is a block diagram of a system for controlling a bistable display, in accordance with an embodiment.

FIG. 8 illustrates a bistable display control system 800 for controlling a bistable display 802, in accordance with an embodiment. The bistable display 802 has a plurality of pixels and may be, for example, the bistable display 400 as described with reference to FIG. 4.

The bistable display control system 800 includes a DC/DC converter 804 that translates power from one voltage to another with high efficiency. The DC/DC converter 804 creates plus/minus high voltage power from a power input 806. The power input 806 may be, for example power (e.g. 5V) coming from a standard wall adapter. The power input 906 provides a high voltage signal as well as logic level power for the bistable display control system 800. In an embodiment, the high voltage power supplied by the DC/DC converter 804 powers high voltage signals for the bistable display 802 as well as high voltage drivers 820.

In an embodiment, the bistable display control system 800 includes a power translator 808, such as a low dropout regulator (LDO) that creates a desired voltage from the power input 806 (e.g. creating 3.3V from 5V).

The bistable display control system 800 includes a microcontroller 810 which acts as a central processing unit (CPU) for the system 800, for responding to input signals 812. The input signals 812 may include display data (e.g. 104, 204) from a web interface transmitted through the Internet (wired or wireless). The microcontroller 810 stores image data for operating the bistable display 802 and executes the image data when the input signal 812 requests a change in the display image.

The bistable display control system 800 includes a controller 813 for creating electrical signals to send to the drivers 820. The controller 813 includes an inverter 814 that takes the input signal 812 and inverts the values at the output (e.g., 0V in=3.3V out, 3.3V in=0V out) to create a differential drive. The inverter 814 inverts a low voltage square wave driving a first operational amplifier (op-amp) 816 so that the phases between the high voltage output signals are inverted.

The controller 813 includes a second high voltage op-amp 818. The first and second op-amps 816, 818 amplify a low voltage input waveform to a high voltage waveform for providing signals to the drivers 820.

The bistable display control system 800 includes the drivers 820 such as cascadable high voltage switches, for example, the driver 700 as described with reference to FIG. 7. The driver 820 connects to rows and columns of the bistable display 802 to control which rows and columns turn on/off. For example, an on signal is a high voltage AC signal with no DC bias and an off signal is ground or float voltage. The drivers 820 are cascadable such that the number of outputs can change to accommodate for varying display sizes, which may be advantageous when covering windows of varying sizes.

Figure 9:
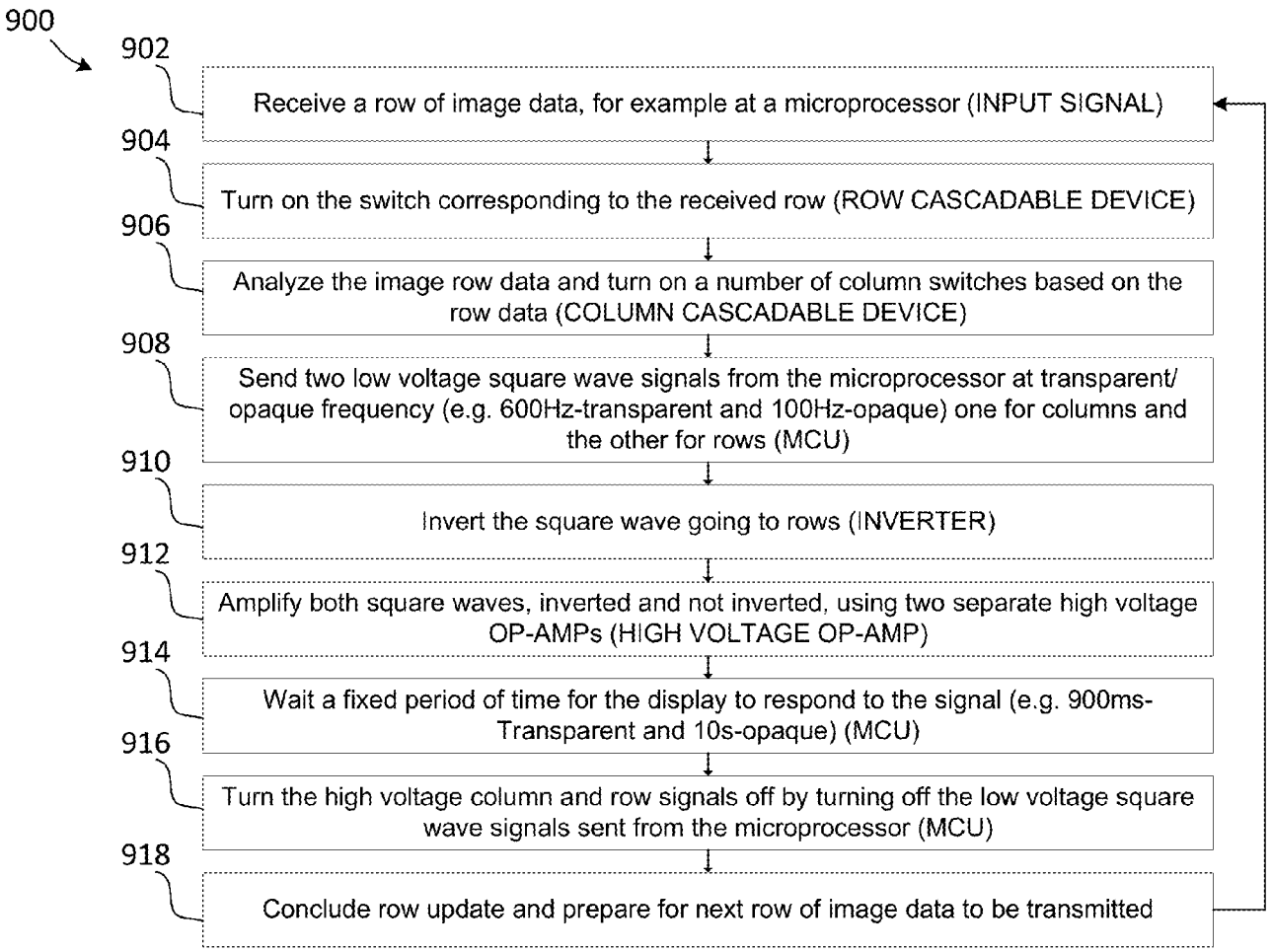
FIG. 9 is a flow diagram of a method for controlling a bistable display, in accordance with an embodiment.

FIG. 9 illustrates a method 900 for controlling a bistable display, in accordance with an embodiment. At 902, image row data is received, for example at a microprocessor. At 904, switches corresponding to the received row are turned on. At 906, the image row data is analyzed and a number of column switches are turned on based on the row data. At 908, first and second low voltage square wave signals are sent from the microprocessor at either of a transparent or opaque frequency (e.g. a 600 Hz frequency for transparent and 100 Hz for an opaque frequency). The first square wave signals is for the columns of the display. The second square wave signal is for the rows of the display. At 910, the second square wave is inverted. At, 912, both the inverted and not inverted square waves are amplified to a high voltage, for example using two separate high voltage op-amps.

At 914, the system waits for a fixed period of time for the delay to respond to the square wave signals. The wait time is based on the time for the bistable display material to respond to the square waves. For example, a. 100 ms wait time for the transparent commands and a 10 s wait time for opaque commands). At 916, the high voltage column and row signals are turned off by turning off the low voltage square wave signals sent from the microprocessor. At 918, the row update is completed and the next row of image data to be transmitted is prepared, starting again at 902.

Figure 10:
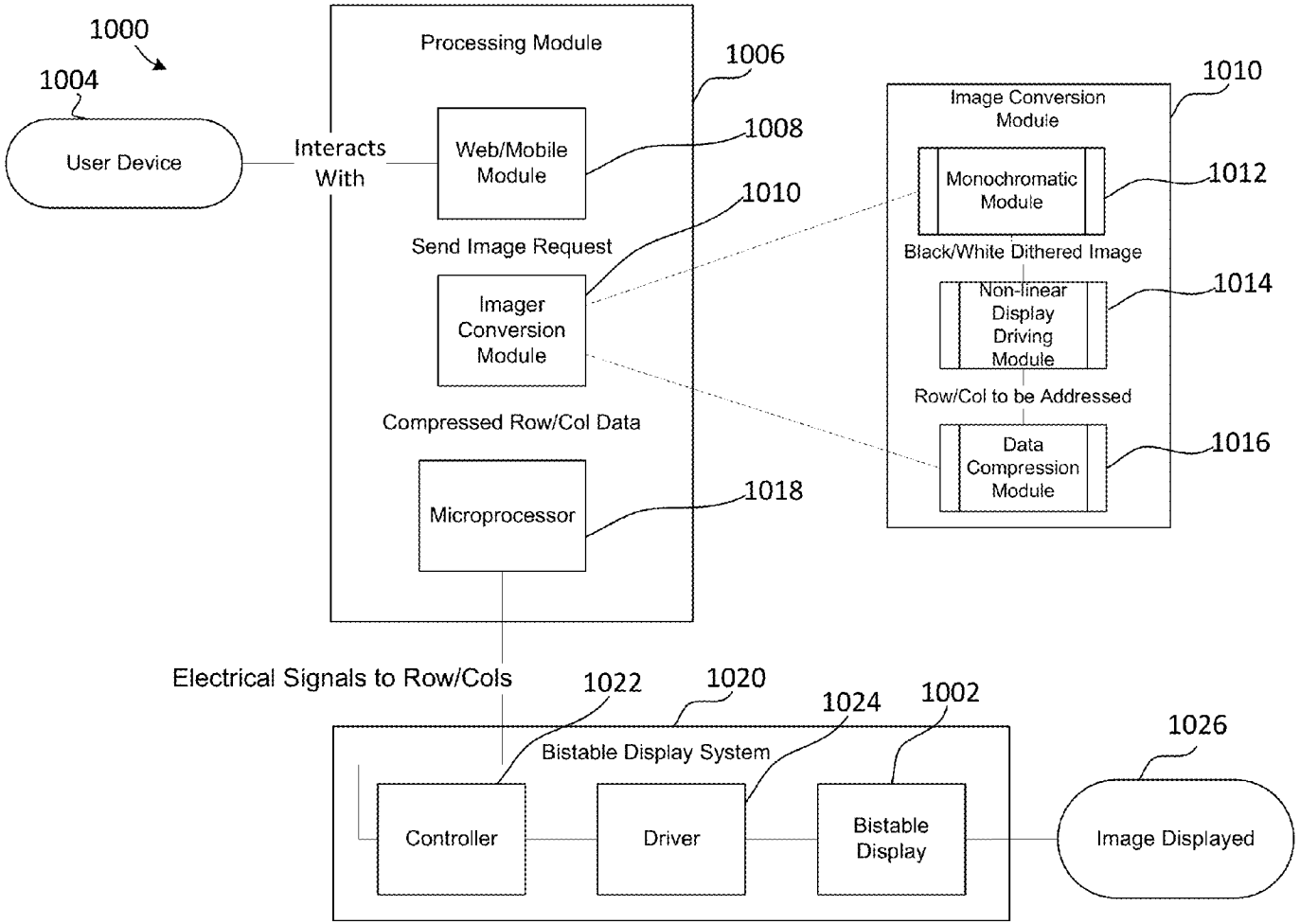
FIG. 10 is a block diagram of a system for displaying an image on a bistable display, in accordance with an embodiment.

FIG. 10 illustrates a system 1000 for displaying an image on a bistable display device 1002, in accordance with an embodiment. A user device 1004 is, for example, a wireless multi-purpose device (e.g. a smart phone, a computer) or a single purpose device (e.g., a bistable display controller). The user device 1004 communicates with a processing module 1006 located, for example, on a computer processor of the user device 1004, a server, and/or at the bistable display 1002.

A user (not shown) inputs a user request into the user device 1004 to initiate the display of the image on the display device 1002. The user request may contain an image address detailing a location of the desired image, for example the webpage address of the image. The image address is used by the processing module to retrieve the image from external databases, such as the World Wide Web. Alternatively, the user request contains the image to be displayed. The image includes the image itself having a plurality of pixels and related data such as Red, Green, Blue, and Opacity data (RGBA values). The image is, for example, text, a photograph, a design, or any computerized image as is known in the art.

The processing module 1006 receives the image at a web mobile module 1008. The web mobile module 1008 sends the image request to an image conversion module 1010. The image conversion module 1010 converts the image into data usable by the bistable display.

The image conversion module 1010 includes a monochromatic module 1012 for converting the image into a monochrome image. The resulting monochrome image may be a black and white dithered image.

Figure 11:
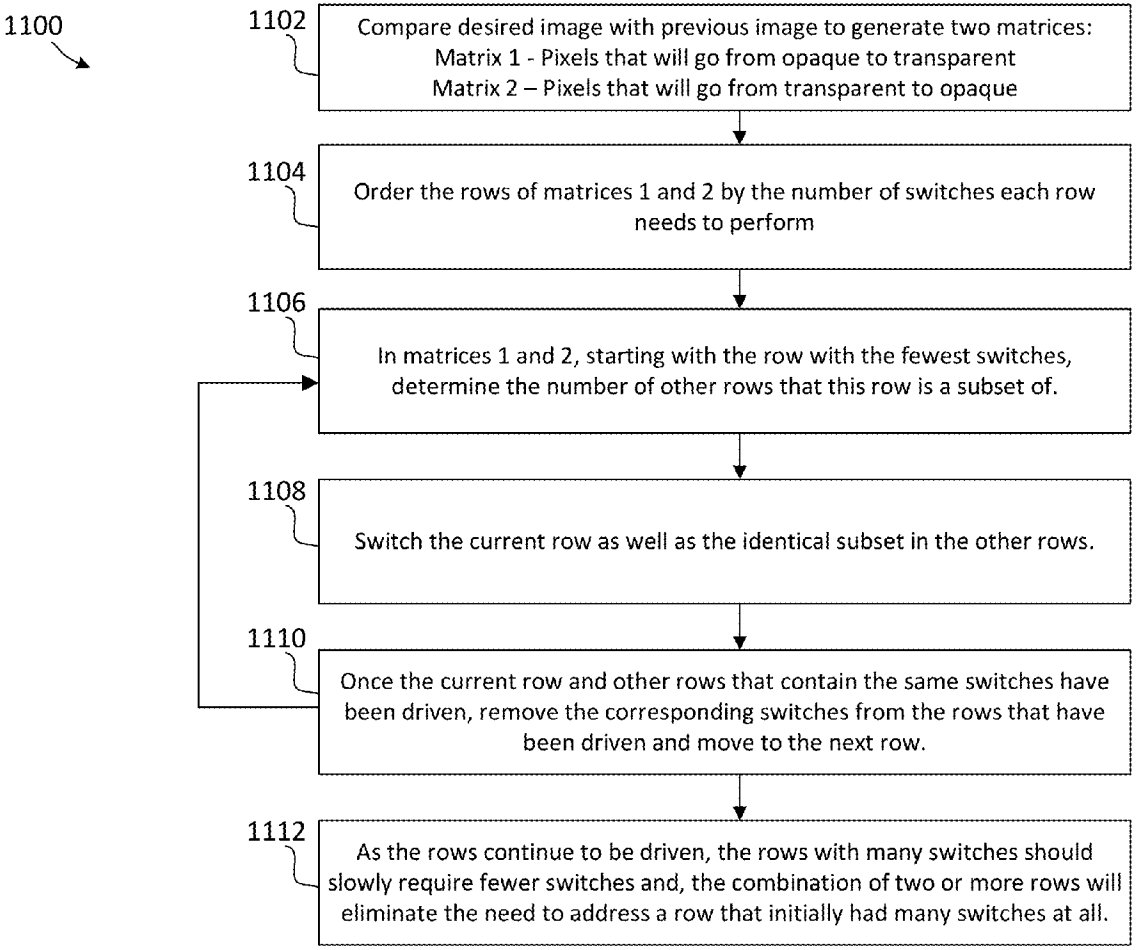
FIG. 11 is a flow chart of a method for driving an image onto a bistable display, in accordance with an embodiment.

The image conversion module 1010 includes a non-linear display driving module 1014 for converting the monochrome image into row and column data for use by the bistable display 1002, for example, as described with respect to FIG. 11.

Figure 12:
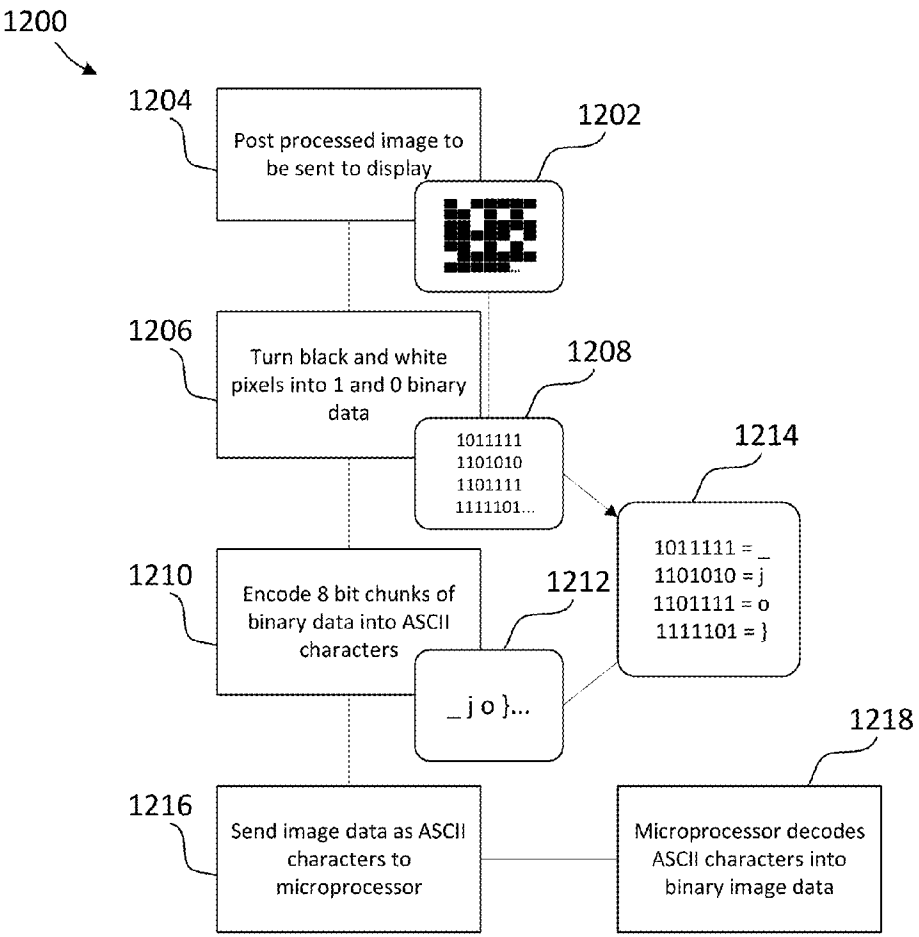
FIG. 12 is a flow chart of a method for compressing image data for displaying on a bistable display, in accordance with an embodiment.

The image conversion module 1010 may also include a data compression module 1016 for compressing the row and column data into compressed row/column data, for example, as described with respect to FIG. 12.

The processing module 1006 sends the compressed row/column data to a microprocessor 1018, for example the microprocessor 810 as described with reference to FIG. 8. The microprocessor 1018 converts the compressed row/column data into electrical signals for use by a bistable display system 1020.

The bistable display system 1020 includes a controller 1022 (e.g. controller 813) for creating row and column electrical signals from the electrical signals. A driver 1024, such as the driver 700 as described with reference to FIG. 7, drives the row and column electrical signals to the bistable display 1002 and the image is displayed at 1026.

FIG. 11 illustrates a method 1100 for driving a bistable display. The method 1100 may be performed by the non-linear display driving module 1014 as described with reference to FIG. 10. At 1102, a first image that is currently being displayed by the bistable display is compared to a second image that is requested to be displayed on the bistable display to identify the pixels that will be switched and those pixels that will not be switched. The comparison between the first image and the second image produces a first matrix which describes the pixels that will switch from opaque to transparent and a second matrix which describes the pixels that will switch from transparent to opaque. The first and second matrices include rows and columns of pixel data.

At 1104, the rows of the first matrix are ordered by the number of switches each row performs, and the rows of the second matrix are ordered by the number of switches each row performs.

At 1106, in the first and second matrices, the number of other rows that this row is a subset of is determined starting with the row having the fewest switches.

At 1108, the current row as well as the identical subset in the other rows is switched.

At 1110, once the current row and other rows that contain the same number of switches have been driven, the corresponding switches from the rows that have been driven are removed and the method 1100 moves to the next row at 1106. At 1112, as the rows continue to be driven, the rows with many switches require fewer switches and the combination of two or more rows eliminates addressing a row that initially had many switches.

FIG. 12 illustrates a method 1200 for compressing a post processed image 1202 on a bistable display. The method 1200 may be performed by the compression module 1016 as described with reference to FIG. 10 to compress the image data.

At 1204, the post processed image 1202 (e.g. monochrome, resized) image is received. At 1206, black and white pixels are converted into 1 and 0 binary data 1208. At 1210, the 1 and 0 binary data is encoded into segments 1212. For example, 8 bit segments can be encoded into ASCII characters 1214 (e.g. 1011111=_; 1101010=j; 1101111=o; 1111101=}).

At 1216, the segments 1212 (e.g. ASCII characters) are sent to a microprocessor (e.g. 1018) where the microprocessor decodes the segments 1212 into binary image data, at 1218 for use by a controller (e.g. 813).

Figures 13A, 13B:
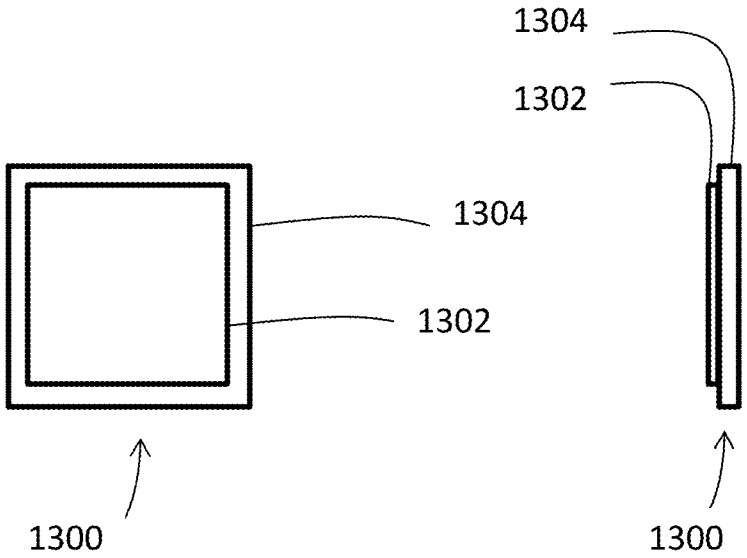
FIGS. 13A and 13B are a front view and a side view, respectively, of a bistable display on a transparent surface, in accordance with an embodiment.

FIGS. 13A and 13B illustrate a front view and a side view of a bistable display system 1300, in accordance with an embodiment. The bistable display system 1300 includes a bistable display 1302 having pixels. The bistable display 1302 is attached (e.g. adhered) to a transparent surface 1304 such as a window. The transparent surface 1304 may be a typical window of glass, Plexiglas, or plastic that is naturally transparent.

Were pixels of the bistable display 1302 are in a transparent state (e.g., pixel 310 as described with reference to FIG. 3B), light passes through both the transparent surface 1304 and the bistable display 1302. Were pixels of the bistable display 1302 are in an opaque state (e.g., pixel 320 as described with reference to FIG. 3B), light passes through that part of the transparent surface 1304 and reflects off of the opaque pixel. The light scattering properties of the bistable display 1302 inhibit light from passing through the transparent surface 1304.

In an embodiment, the bistable displays described may be used as semi-dynamic signage for windows. For example, businesses currently either have to use static signage material like posters, stickers, decals, etc. which are static, or use TVs and monitors which consume a lot of power, block views, and do not scale to the size of the TV. The semi-dynamic signage bistable display on windows may be transparent, have low power use, be customizable in size, and/or provide text or image aesthetics.

While the above description provides examples of one or more apparatus, methods, or systems, it will be appreciated that other apparatus, methods, or systems may be within the scope of the claims as interpreted by one of skill in the art.

What is claimed is:

1. A bistable display system comprising:

a plurality of pixels, arranged in pixel rows and pixel columns, each pixel comprising:

a first transparent and conductive substrate;

a second transparent and conductive substrate; and a bistable material between the first and second substrates having a first state and a second state; and a driver for driving the pixel rows and pixel columns to change the state of at least one targeted pixel, wherein the driver includes:

a column driver having a plurality of single pole double throw switches to simultaneously drive the pixel columns by a column voltage and a ground; and a row driver having a single pole single throw switch to alternatively drive the pixel rows by a row voltage or disconnect the pixel row; and wherein the difference between the row voltage and column voltage is a drive voltage.

2. The bistable display system of claim 1, wherein the first state is a transparent state such that the pixel is transparent and the second state is an opaque state such that the pixel is opaque.

3. The bistable display system of claim 2, wherein the bistable material is a liquid crystal material that changes between the first and second states based on the drive voltage applied across the first and second substrates.

4. The bistable display system of claim 3 further comprising:

a power source for providing the drive voltage to the plurality of pixels, and wherein when the power source is disconnected from the plurality of pixels the state of the bistable material does not change.

5. The bistable display system of claim 1, wherein the bistable material is a smectic A liquid crystal.

6. The bistable display system of claim 1, wherein the driver is a cascadable driver interface.

7. The bistable display system of claim 1, wherein the bistable material has a change threshold voltage that initiates the change between the first and second states;

wherein the column voltage is less than the change threshold voltage;

wherein the row voltage is less than the change threshold voltage; and wherein the drive voltage is greater than the change threshold voltage.

8. The bistable display system of claim 7, further comprising:

a controller for creating the row voltage and the column voltage to send to the row and column drivers.

9. The bistable display of system claim 8, wherein the controller includes:

a first operational amplifier for amplifying a low voltage input signal to provide the column voltage;

an inverter for inverting the low voltage input signal to provide an inverted low voltage signal; and a second operational amplifier for amplifying the inverted low voltage signal to provide the row voltage, such that the row voltage is inverse to the column voltage.

10. The bistable display of system claim 9, wherein the column voltage and the row voltage are high voltage square waves.

11. The bistable display system of claim 8, further comprising:

a processing module for processing image display data into the low voltage input signal for use by the controller.

12. The bistable display of system claim 11, wherein the processing module comprises any one or more of:

a monochromatic module for converting the image display data into monochrome image data;

a non-linear display driving module for converting the monochrome image data into row and column data; and a data compression module for compressing the row and column data into compressed row/column data.

13. A method for controlling a bistable display, the method comprising:

driving a plurality of pixels including at least one target pixel and at least one non-target pixel, arranged in pixel rows and pixel columns;

applying a voltage difference across at least one target column and at least one target row to switch the at least one target pixel between a transparent state and an opaque state;

driving the at least one target column to a column voltage;

grounding non-targeted columns;

driving the at least one target row to a row voltage, wherein the column and row voltages are 180 degrees out of phase and equal in magnitude, such that the voltage difference is equal to twice the column voltage; and disconnecting non-targeted rows such that non-targeted pixels will be driven to a float voltage, wherein the float voltage is equal to the mean of the column voltages.

14. The method of claim 13 further comprising:

creating and amplifying a first signal at a transparent or opaque frequency for the target column;

creating, inverting, and amplifying a second signal at the transparent or opaque frequency for the target row; and waiting a fixed period of time for the bistable display to respond to the signals before turning off the first and second signals.

15. The method of claim 13 further comprising:

comparing a first image that is currently being displayed by the bistable display to a second image that is requested to be displayed on the bistable display; and identifying the target pixels to be switched.

16. The method of claim 13 further comprising:

receiving monochrome image data including black and white pixel data;

converting the black and white pixel data into binary data;

encoding the binary data into characters; and sending the characters to the bistable display.

17. A method for controlling a bistable display, the method comprising:

driving a plurality of pixels including at least one target pixel and at least one non-target pixel, arranged in pixel rows and pixel columns;

applying a voltage difference across at least one target column and at least one target row to switch the at least one target pixel between a transparent state and an opaque state;

comparing a first image that is currently being displayed by the bistable display to a second image that is requested to be displayed on the bistable display;

identifying the target pixels to be switched; and producing a first matrix which describes the target pixels for switching from opaque to transparent;

producing a second matrix which describes the target pixels for switching from transparent to opaque;

wherein the first and second matrices include rows and columns of pixel data;

ordering the rows of the first and second matrices by the number of switches each row performs;

starting with the row with the fewest switches, determining the number of other rows that the row is a subset of;

switching the current row and the identical subset in the other rows; and once the current row and other rows that contain the same number of switches have been driven, removing the corresponding switches from the rows that have been driven.

* * * * *